US008997984B2

(12) United States Patent
Kuo et al.

(10) Patent No.: US 8,997,984 B2
(45) Date of Patent: Apr. 7, 2015

(54) LAYERED STRUCTURE FOR PAPER BOX

(71) Applicant: Golden Arrow Printing, Co., Ltd., New Taipei (TW)

(72) Inventors: Chien-Kuan Kuo, New Taipei (TW); Chun-Huang Huang, New Taipei (TW)

(73) Assignee: Golden Arrow Printing, Co., Ltd., New Taipei (TW)

( * ) Notice: Subject to any disclaimer, the term of this patent is extended or adjusted under 35 U.S.C. 154(b) by 49 days.

(21) Appl. No.: 13/943,883

(22) Filed: Jul. 17, 2013

(65) Prior Publication Data

US 2015/0021327 A1 Jan. 22, 2015

(51) Int. Cl.

| | |
|---|---|
| ***B65D 25/10*** | (2006.01) |
| ***B65D 51/20*** | (2006.01) |
| ***B65D 43/02*** | (2006.01) |

(52) U.S. Cl.

CPC ..... *B65D 51/20* (2013.01); *B65D 43/0222* (2013.01); *B65D 25/10* (2013.01)

(58) Field of Classification Search

USPC ..... 220/4.27, 23.83, 23.86, 23.87, 521, 220/796, 254.9, 142; 206/501, 504, 583, 206/776, 320

See application file for complete search history.

(56) References Cited

U.S. PATENT DOCUMENTS

| | | | | |
|---|---|---|---|---|
| 2,585,923 | A * | 2/1952 | Epler et al. | 206/246 |
| 2,606,708 | A * | 8/1952 | Irvan | 220/796 |
| 4,314,650 | A * | 2/1982 | Cillario | 220/23.83 |
| 4,340,138 | A * | 7/1982 | Bernhardt | 206/216 |
| 4,606,460 | A * | 8/1986 | Luray | 206/583 |
| 4,807,776 | A * | 2/1989 | Cortopassi | 220/23.83 |
| 5,363,977 | A * | 11/1994 | Hoff | 220/4.27 |
| 5,511,684 | A * | 4/1996 | Weaver, Jr. | 220/630 |
| 5,749,460 | A * | 5/1998 | Rice | 220/23.83 |
| 6,302,274 | B1 * | 10/2001 | Ridgeway | 206/583 |
| 6,367,624 | B1 * | 4/2002 | Szczepanski et al. | 206/305 |
| 7,878,326 | B2 * | 2/2011 | Andre et al. | 206/320 |
| 2006/0266672 | A1 * | 11/2006 | Young | 206/776 |
| 2008/0061060 | A1 * | 3/2008 | Aubrey | 220/23.87 |
| 2009/0200301 | A1 * | 8/2009 | Beekman et al. | 220/4.27 |
| 2011/0108449 | A1 * | 5/2011 | Andre et al. | 206/486 |

* cited by examiner

*Primary Examiner* — Steven A. Reynolds

*Assistant Examiner* — King M Chu

(74) *Attorney, Agent, or Firm* — Chun-Ming Shih; HDLS IPR Services

(57) ABSTRACT

A layered structure for a paper box includes an inner box, an outer cover and a carrying plate. The inner box is formed with a first opening, and a stepped surface is formed at the inner edge of the first opening. The outer periphery of the carrying plate is formed with a flange, and the carrying plate is disposed in the first opening and the flange thereof is supported by the stepped surface. The outer cover is formed with a second opening, the second opening is sleeved with the first opening, and the outer cover is served to cover the first opening and cover outer sides of the inner box. Because the stepped surface is integrally formed in the inner box, the manufacture procedure of the layered structure for a paper box can be simplified thereby reducing material stock and lowering production cost.

6 Claims, 4 Drawing Sheets

LAYERED STRUCTURE FOR PAPER BOX

BACKGROUND OF THE INVENTION

1. Field of the Invention

The present invention relates to a paper box, especially to a layered structure for a paper box.

2. Description of Related Art

Paper boxes are commonly used in our lives, and a lot of products are packaged by the paper boxes, especially most of the portable electronic devices are packaged by the paper boxes. The portable electronic device available in the market includes a main body and its accessories; in order to provide a convenient package, the interior of the paper box is often divided into several partitions for respectively accommodating the main body and the accessories. Take a mobile phone for example, the paper box is often partitioned into a top and a bottom layer, the top layer is used for accommodating the main body, and the bottom layer is used for accommodating the accessories. A general means for partitioning is to provide a tray in the paper box for accommodating the main body, and the inner wall of the paper box is formed with a step for supporting the periphery of the tray. A conventional paper box is made by adhering two layers of paper boards, so a step can be formed at the peripheries of the two paper boards. However, one major disadvantage of the related art is that the material stock and the adhering procedure for the two paper boards would cause unnecessary waste in production cost.

Accordingly, the applicant of the present invention has devoted himself for improving the mentioned disadvantage.

SUMMARY OF THE INVENTION

The present invention is to provide a layered structure for a paper box in which a carrying plate is disposed therein.

Accordingly, the present invention provides a layered structure for a paper box, which includes an inner box, an outer cover and a carrying plate. The inner box is formed with a first opening, a stepped surface is formed at the inner edge of the first opening. The outer periphery of the carrying plate is formed with a flange, the carrying plate is disposed in the first opening and the flange thereof is supported by the stepped surface. The outer cover is formed with a second opening, the second opening is sleeved with the first opening, the outer cover is served to cover the first opening and cover outer sides of the inner box.

Preferably, according to the mentioned layered structure for a paper box, four concerns of the inner box are respectively formed with a first fillet angle.

Preferably, according to the mentioned layered structure for a paper box, four concerns of the outer cover are respectively formed with a second fillet angle.

Preferably, according to the mentioned layered structure for a paper box, the radius of the first fillet angle is larger than the radius of the second fillet angle.

Preferably, according to the mentioned layered structure for a paper box, the lateral wall of the inner box is outwardly inclined for forming a draft angle.

Preferably, according to the mentioned layered structure for a paper box, the draft angle is between 1 to 2 degrees.

Preferably, according to the mentioned layered structure for a paper box, the physical thickness of the carrying plate is between 1 mm to 1.5 mm.

Preferably, according to the mentioned layered structure for a paper box, the width of the flange is between 1.5 mm to 2 mm.

Preferably, according to the mentioned layered structure for a paper box, the carrying plate is formed with a through hole.

Preferably, according to the mentioned layered structure for a paper box, the stepped surface integrally formed at the inner edge of the inner box is served to support the carrying plate. Comparing to the related art of adhering two layers of paper boards, the present invention has advantages of reducing material stock and lowering production cost.

DETAILED DESCRIPTION OF THE INVENTION

A preferred embodiment of the present invention will be described with reference to the drawings.

Figure 1:
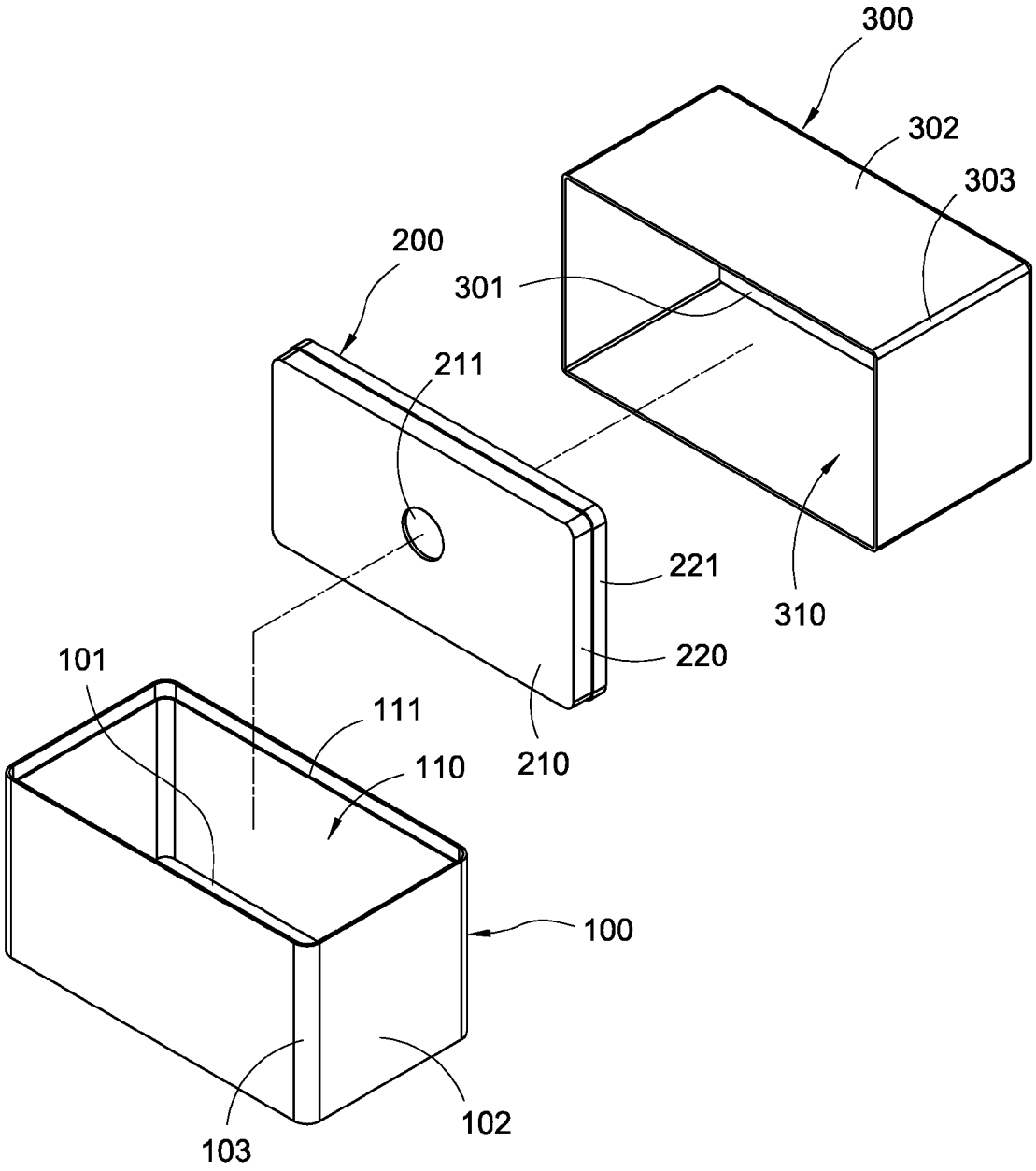
FIG. 1 an exploded view showing the layered structure for a paper box according to a preferred embodiment of the present invention.
Figure 2:
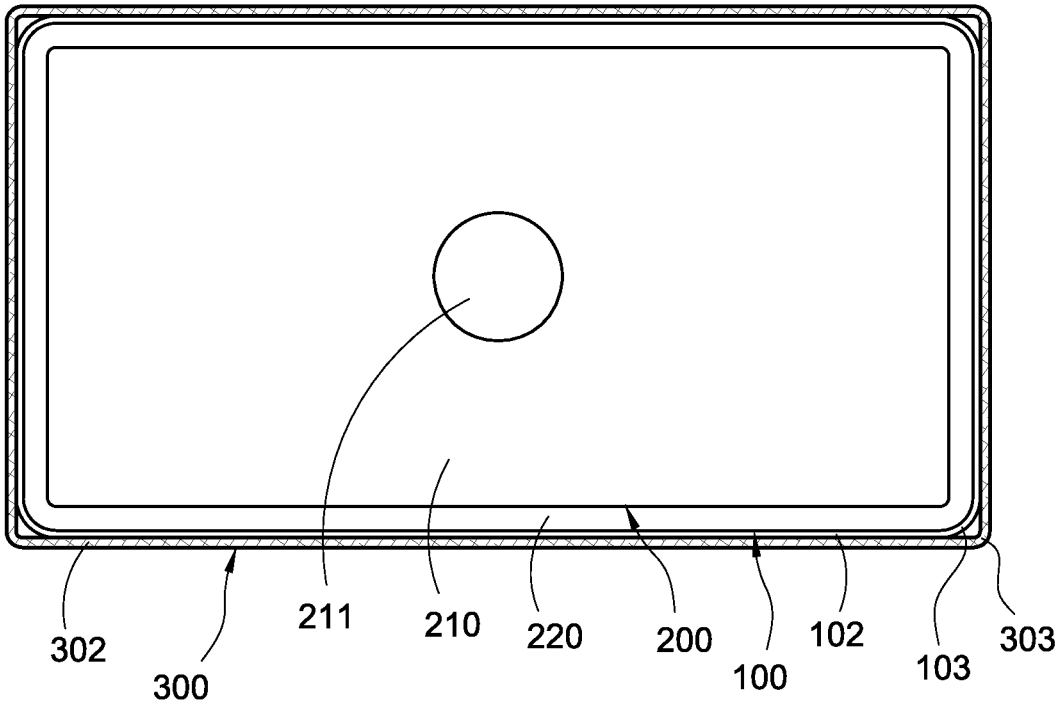
FIG. 2 a transversal cross sectional view showing the layered structure for a paper box according to a preferred embodiment of the present invention.
Figure 3:
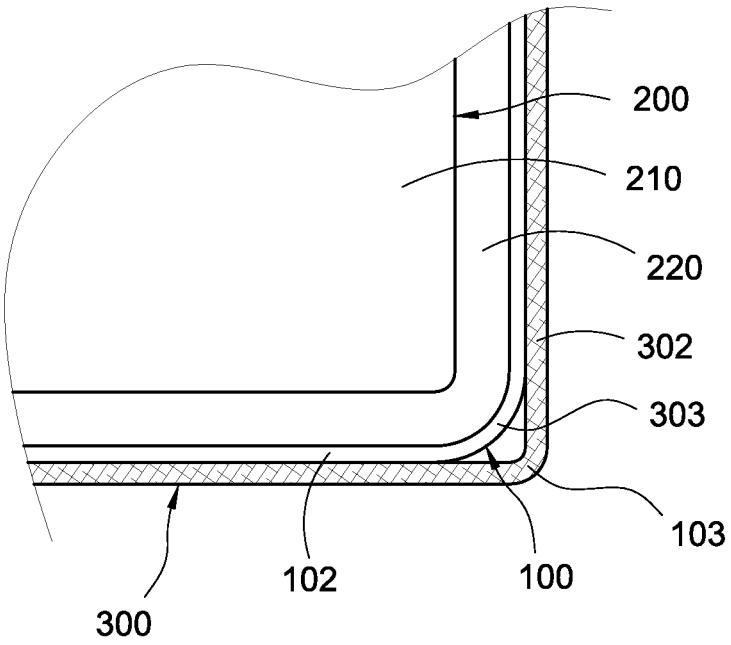
FIG. 3 is a partially enlarged view showing the layered structure for a paper box shown in FIG. 2.

Please refer to FIG. 1 to FIG. 3, according to a preferred embodiment of the present invention, a layered structure for a paper box includes an inner box 100, an outer cover 200 and a carrying plate 300.

According to this embodiment, the inner box 100 is preferably to be formed as a rectangular box member having an opening, and preferably to be formed through injecting pulp into a mold. The inner box 100 includes a base board 101 and four first lateral boards 102. The base board 101 is substantially formed in a rectangular shape, the four first lateral boards 102 are connected to each other and surround the base board 101, and each of the first lateral boards 102 is vertically and respectively connected to four sides of the base board 101, thereby forming a first opening 110 between the four first lateral boards 102. A first fillet angle 103 is formed at the side where any two of the first lateral boards 102 being connected. In addition, a stepped surface 111 is formed at an inner edge of the first opening.

Figure 4:
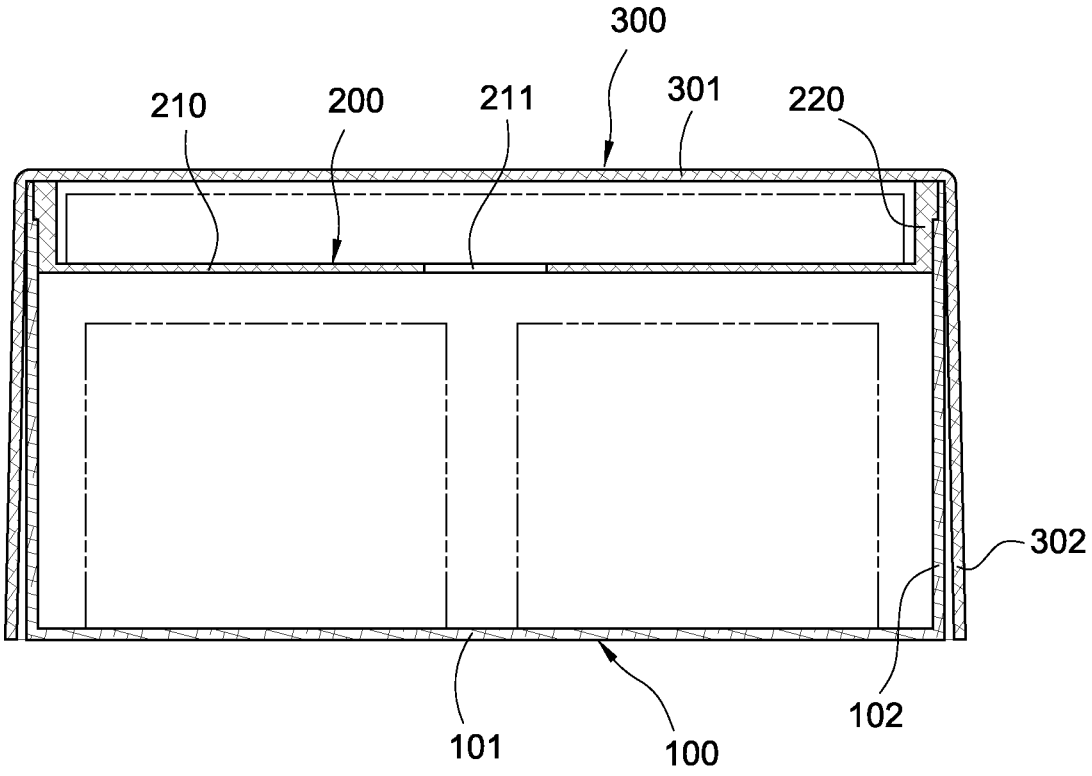
FIG. 4 a longitudinal cross sectional view showing the layered structure for a paper box according to a preferred embodiment of the present invention.
Figure 5:
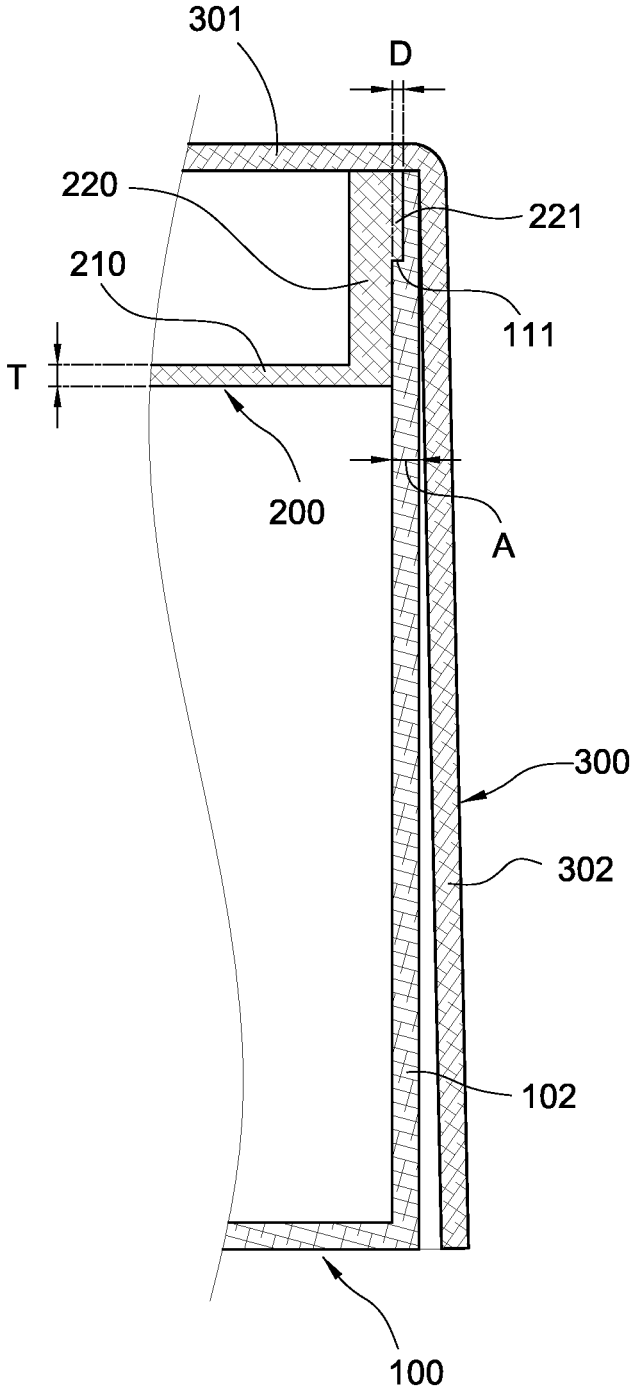
FIG. 5 is a partially enlarged view showing the layered structure for a paper box shown in FIG. 4.

Please refer to FIG. 4 and FIG. 5, the four first lateral boards 102 are preferably and slightly inclined towards outward at each corresponding side of the base board 101 thereby respectively forming with a draft angle A. The draft angle A is preferably to be between 1 to 2 degrees.

Please refer to FIG. 1, FIG. 4 and FIG. 5, according to this embodiment, the carrying plate 200 is preferably to be formed as a rectangular plate member, and preferably to be formed through injecting pulp into a mold. The carrying plate 200 includes a carrying board 210 and a surround wall 220 surrounding the carrying board 210. The carrying board 210 is substantially formed in a rectangular shape, and formed with a through hole 211. The surround wall 220 is connected to four sides of the carrying board 210, and the outer periphery of the surround wall is formed with a flange 221.

The carrying plate 200 is disposed in the first opening 110 and the flange 221 thereof is supported by the stepped surface 111, the physical thickness T of the carrying board 210 and the surround wall 220 is between 1 mm to 1.5 mm, and the width D of the flange is preferably to be between 1.5 mm to 2 mm thereby being enabled to provide a sufficient support force to the carrying plate 200. In addition, the through hole 221 allows a user to use his finger to take out the carrying plate 200 from the inner box 100.

Please refer from FIG. 1 to FIG. 4, according to this embodiment, the outer cover 300 is preferably to be formed as a rectangular cover member having an opening, and includes a cover board 301 and four second lateral boards 302. The cover board 301 is substantially formed in a rectangular shape, the four second lateral boards 302 are connected to each other and surround the cover board 301, and each of the second lateral boards 302 is vertically and respectively connected to four sides of the cover board 301, thereby forming a second opening 310 between the four second lateral boards 302. A second fillet angle 303 is formed at the side where any two of the second lateral boards 302 being connected, the radius of the first fillet angle 103 is preferably to be larger than the radius of the second fillet angle 303. The second opening 310 is sleeved with the first opening 110, thereby enabling the cover board 301 to cover the first opening 110 and the four second lateral boards 302 to respectively cover the outer sides of the four first lateral boards 102.

According to the present invention, the stepped surface 111 integrally formed at the inner edge of the first opening 110 of the inner box 100 is served to support the carrying plate 200. Comparing to the related art of utilizing two layers of paper boards being stacked for forming a step, the structure provided by the present invention save the procedure of adhering paper boards thereby reducing the stocked material, thus the layered structure for a paper box provided by the present invention requires less production cost comparing to the related art.

Moreover, according to the layer structure for a paper box provided by the present invention, the radius of the first fillet angle 103 of the inner box 100 is larger than the radius of the second fillet angle 303 of the outer cover 300. When the inner box 100 is sleeved with the outer cover 300, the first fillet angle 103 is located at the inner side of the second fillet angle 303, thereby forming a gap between the first lateral board 102 and the second lateral board 302 which allows the user to easily separate the inner box 100 and the outer cover 300.

Furthermore, each of the first lateral boards 102 of the inner box 100 is outwardly inclined for forming the draft angle A, so the mold leasing operation processed after the inner box 100 being formed can be facilitated, and the friction between the inner box 100 and the outer cover 300 is reduced thereby allowing the inner box 100 and the outer cover 300 to be easily separated.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A layered structure for a paper box, including:

an inner box formed with a first opening, wherein a stepped surface is formed at the inner edge of the first opening;

a carrying plate, wherein the outer periphery thereof is formed with a flange, and the carrying plate is disposed in the first opening and the flange is supported by the stepped surface; and an outer cover formed with a second opening, wherein the second opening is sleeved with the first opening, and the outer cover is served to cover the first opening and to cover outer sides of the inner box, wherein four corners of the inner box are respectively formed with a first fillet angle, wherein four corners of the outer cover are respectively formed with a second fillet angle, and wherein the radius of the first fillet angle is larger than the radius of the second fillet angle.

2. The layered structure for a paper box according to claim 1, wherein the lateral wall of the inner box is outwardly inclined for forming a draft angle.

3. The layered structure for a paper box according to claim 2, wherein the draft angle is between 1 to 2 degrees.

4. The layered structure for a paper box according to claim 1, wherein the physical thickness of the carrying plate is between 1 mm to 1.5 mm.

5. The layered structure for a paper box according to claim 4, wherein the width of the flange is between 1.5 mm to 2 mm.

6. The layered structure for a paper box according to claim 1, wherein the carrying plate is formed with a through hole.

* * * * *